US008407825B2

(12) United States Patent
Kao

(10) Patent No.: US 8,407,825 B2
(45) Date of Patent: Apr. 2, 2013

(54) SHOWER NOZZLE HAVING A BRUSH

(76) Inventor: Shen-Mu Kao, Bade (TW)

( * ) Notice: Subject to any disclaimer, the term of this patent is extended or adjusted under 35 U.S.C. 154(b) by 672 days.

(21) Appl. No.: 12/565,972

(22) Filed: Sep. 24, 2009

(65) Prior Publication Data

US 2010/0083438 A1 Apr. 8, 2010

(30) Foreign Application Priority Data

Oct. 3, 2008 (TW) ..... 97138020 A

(51) Int. Cl.
*A47K 7/02* (2006.01)

(52) U.S. Cl. ..... 4/606; 4/567; 4/615

(58) Field of Classification Search ..... 4/606, 567, 4/615; 15/29, 104.92
See application file for complete search history.

(56) References Cited

U.S. PATENT DOCUMENTS

| | | | | | |
|---|---|---|---|---|---|
| 4,151,623 | A * | 5/1979 | Steere | 15/21.1 |
| 4,841,590 | A * | 6/1989 | Terry et al. | 15/28 |
| 5,093,943 | A * | 3/1992 | Wei | 4/615 |
| 5,239,712 | A * | 8/1993 | Kinder | 4/606 |
| 5,345,640 | A * | 9/1994 | Goss | 15/88.2 |
| 5,382,221 | A * | 1/1995 | Hsu et al. | 601/114 |
| 5,640,735 | A * | 6/1997 | Manning | 15/29 |
| 6,151,728 | A * | 11/2000 | Wright et al. | 4/606 |
| 6,730,051 | B2 * | 5/2004 | Lin | 601/112 |
| 7,156,108 | B2 * | 1/2007 | Xin | 132/322 |

* cited by examiner

*Primary Examiner* — Tuan N Nguyen
(74) *Attorney, Agent, or Firm* — Chun-Ming Shih

(57) ABSTRACT

A shower nozzle having a brush includes a driving unit and a brush body. The driving unit is used to get power for driving the brush body. The driving unit includes a motor, bevel gears and a gear disc. The shower nozzle is compact in size and provides a brushing function when taking a bath.

4 Claims, 3 Drawing Sheets

SHOWER NOZZLE HAVING A BRUSH

BACKGROUND OF THE INVENTION

1. Field of the Invention

The present invention relates to a cleaning device for cleaning and brushing a human body.

2. Description of the Prior Art

In general, a hand-held shower nozzle is coupled with a hose which is connected to a faucet. The shower nozzle uses a flow splitter to control water flow and its output area. People are used to have a shower nozzle when taking a bath.

A conventional shower nozzle only has a function to output water for washing a human body when taking a bath. It is unable to scrub the body. Accordingly, people may use a brush to clean the body thoroughly. However, it is not convenient to take a brush and a shower nozzle at one time.

In Taiwan, there are many patents relating to bathing machines. However, the bathing machines have high cost, are larger in size, and are not easy to install. Therefore, they are not popular in the market. Accordingly, the inventor of the present invention has devoted himself based on his many years of practical experiences to solve this problem.

SUMMARY OF THE INVENTION

The primary object of the present invention is to provide a shower nozzle having a brush for supplying water and providing a brushing function, which satisfies consumers when taking a bath.

In order to achieve the aforesaid object, the present invention includes a driving unit disposed in a main body. The driving unit is coupled with a brush body which is exposed out of the main body and driven by the driving unit.

The main body includes a storing member therein. When the main body is disengaged from a water tube, the main body will be charged in the form of wire charge or sensing charge.

The driving unit includes a motor and at least two bevel gears. The motor has an output shaft connected with the brush body at an angle of ninety degrees. The shower nozzle is compact in size.

The shower nozzle can be started manually. Alternatively, the shower nozzle is provided with a sensing member. When the shower nozzle approaches a human body, it can automatically start the brush body and stop after a predetermined period of time.

DETAILED DESCRIPTION OF THE PREFERRED EMBODIMENTS

Embodiments of the present invention will now be described, by way of example only, with reference to the accompanying drawings.

Figure 1:
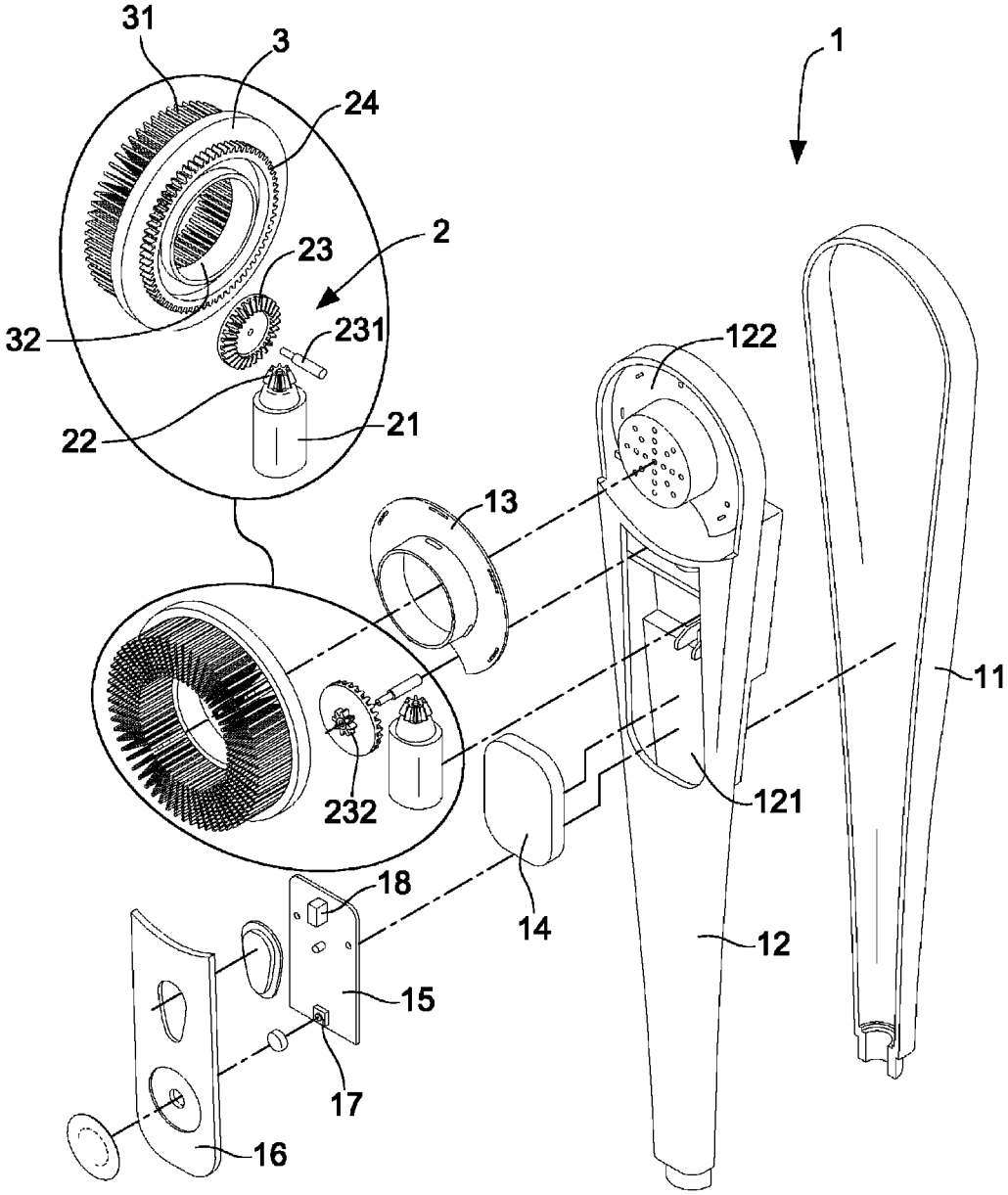
FIG. 1 is an exploded view of the present invention.
Figure 2:
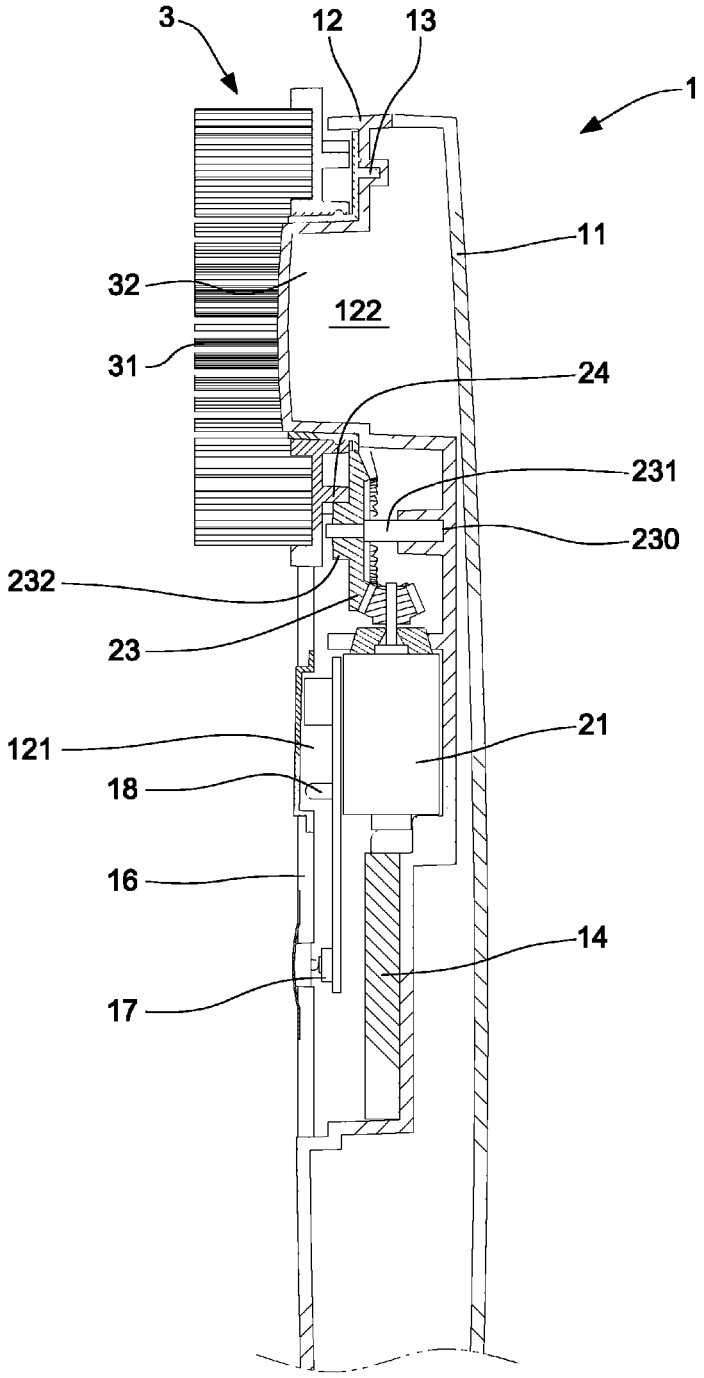
FIG. 2 is a cross-sectional view of the present invention.

As shown in FIGS. 1 and 2, a shower nozzle having a brush according to a preferred embodiment of the present invention comprises a main body 1, a driving unit 2, and a brush body 3.

The main body 1 is composed of a first housing 11 and a second housing 12. The first housing 11 being hollow allows water to flow therethrough. The second housing 12 includes an accommodating part 121 and an upper part 121. The accommodating part 121 is adapted to receive a power storing member 14, a circuit unit 15 and a panel 16. The circuit unit 15 is provided with a switch 17 and a sensing member 18 thereon. The upper part 122 is incorporated with a collar 13 for water to flow therefrom.

The driving unit 2 includes a motor 21, a bevel gear 22, a driven bevel gear 23, a small gear 232 and a gear disc 24. The motor 21 has an output shaft coupled with the bevel gear 22. The bevel gear 22 meshes with the driven bevel gear 23 at an angle of ninety degrees. The driven bevel gear 23 has a shaft 231 located in a shaft hole 230. The small gear 232 is disposed on the back of the driven bevel gear 23. The small gear 232 meshes with the gear disc 24 in the same direction.

The brush body 3 has bristles 31 on an outer side thereof and an outlet 32 at a central portion thereof. The brush body 3 is coupled with the gear disc 24.

Figure 3:
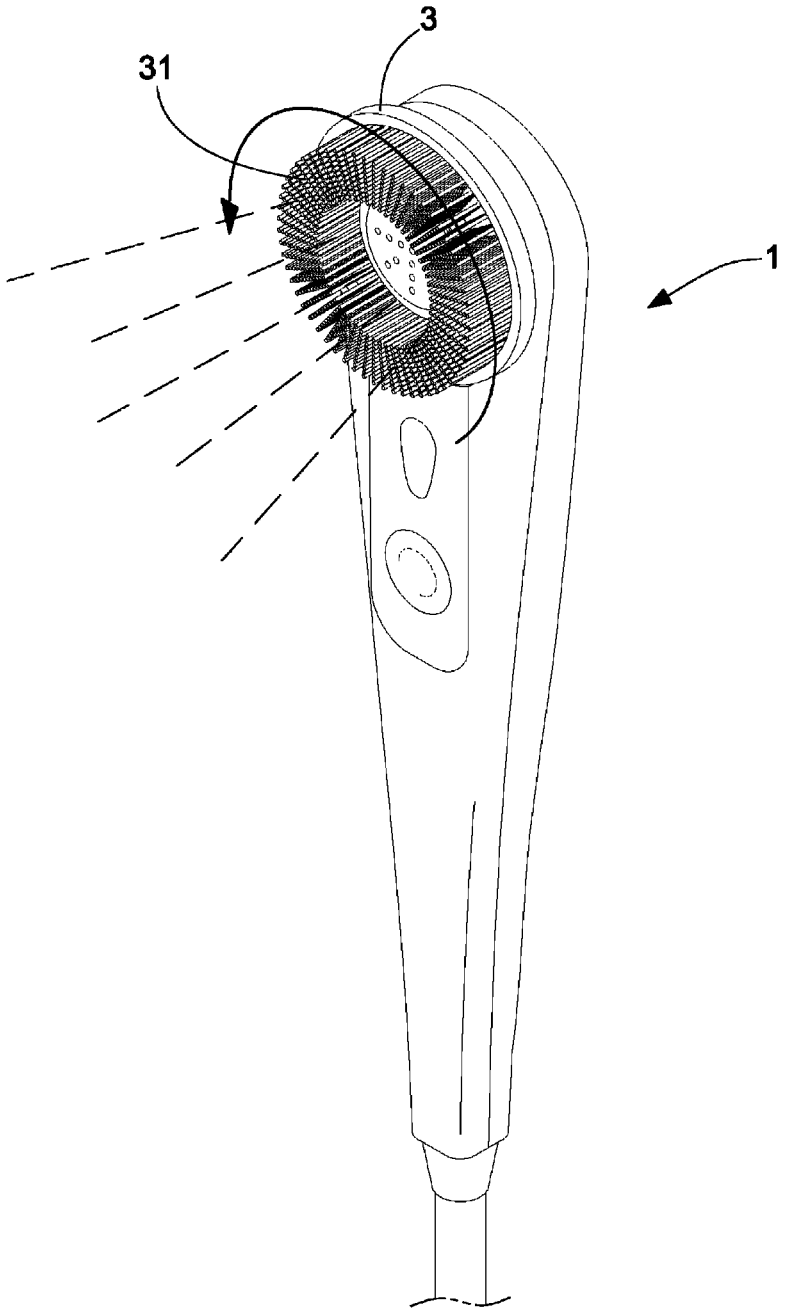
FIG. 3 is a schematic view of the present invention in an operating status.

As shown in FIG. 3, the driving unit 2 is started to drive the bevel gear 22 which brings the driven bevel gear 23 to turn, and then the small gear 232 and the gear disc 24 are also driven to turn. Because the brush body 3 is integrally formed with the gear disc 24, the brush body 3 is driven to turn by the gear disc 24. The brush body 3 is used to scrub a human body for cleaning.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shower nozzle having a brush, comprising:

a main body composed of a first housing and a second housing, the first housing being hollow for water to flow therethrough;

a driving unit disposed in the main body, the driving unit comprising a motor, a bevel gear, a driven bevel gear, a small gear and a gear disc, the motor having an output shaft coupled with the bevel gear, the bevel gear meshing with the driven bevel gear at an angle of ninety degrees, the driven bevel gear having a shaft located in a shaft hole, the small gear being disposed on a back of the driven bevel gear;

a brush body having bristles on an outer side thereof and an outlet at a central portion thereof, the brush body being coupled with the gear disc;

a collar incorporated in an upper part of the second housing and arranged behind the brush body, and part of the collar coupling to the brush body by extending through the center of the brush body for preventing water from leaking on the driving bevel gear; and a sensing member coupled to the main body and configured so that when the shower nozzle approaches a human body, the brush body can be automatically started and stopped after a predetermined period of time.

2. The shower nozzle having a brush as claimed in claim 1, wherein the second housing includes an accommodating part.

3. The shower nozzle having a brush as claimed in claim 2, wherein the accommodating part is adapted to receive a power storing member, a circuit unit and a panel.

4. The shower nozzle having a brush as claimed in claim 3, wherein the circuit unit is provided with a switch and the sensing member thereon.

* * * * *